US005531051A

United States Patent [19]

Chenier, Jr. et al.

[11] Patent Number: 5,531,051

[45] Date of Patent: Jul. 2, 1996

[54] CONNECTOR CLIP FOR CORNER BEAD

[75] Inventors: Gary J. Chenier, Jr., W. Palm Beach, Fla.; Gary J. Maylon, Trussville, Ala.

[73] Assignee: Alabama Metal Industries Corporation, Birmingham, Ala.

[21] Appl. No.: 320,433

[22] Filed: Oct. 7, 1994

[51] Int. Cl.[6] ..... E04B 1/00

[52] U.S. Cl. ..... 52/255; 52/256; 52/257; 52/417

[58] Field of Search ..... 52/254, 255, 256, 52/257, 417

[56] References Cited

U.S. PATENT DOCUMENTS

| | | | |
|---|---|---|---|
| Re. 34,547 | 2/1994 | Weldy . | |
| 125,844 | 4/1872 | Rice | 52/255 |
| 1,587,034 | 6/1926 | Planett | 52/257 |
| 1,769,813 | 7/1930 | Winter | 52/255 |
| 1,772,694 | 8/1930 | White . | |
| 3,974,619 | 8/1976 | Turner . | |
| 4,071,993 | 2/1978 | Stewart et al. | 52/417 X |
| 4,733,986 | 3/1988 | Kenning et al. . | |
| 5,003,743 | 4/1991 | Bifano et al. . | |
| 5,048,247 | 9/1991 | Weldy . | |
| 5,086,598 | 2/1992 | Weldy . | |

OTHER PUBLICATIONS

Vinyl Accessories Catalog, 8 pp. no date identified.

*Primary Examiner*—Carl D. Friedman
*Assistant Examiner*—W. Glenn Edwards
*Attorney, Agent, or Firm*—Trexler, Bushnell, Giangiorgi & Blackstone, Ltd.

[57] ABSTRACT

An extruded strip joining system including a strip and a clip which cooperate to join free ends of extruded strips in precise abutment to maintain alignment of the strips. The strip joining system includes the strip which has an elongated junction portion and at least one elongated flange extending parallel to and away from the junction portion. The junction portion includes an internal surface and an external surface. Protruding structures are provided on the internal surface of the junction portion. A pair of axially elongated tabs are formed on the protruding structures depending from internal surface of the junction portion. The tabs are axially elongated along the strip and extend inwardly defining a channel therebetween. The clip is configured to engage the tabs thereby retaining the clip in the channel. Two strips are positioned with free ends abutting each other and a clip is positioned over the channel and pressed into engagement with the tabs. Engagement of the clip with the tabs provides precise end-to-end positioning and axial alignment of the strips.

16 Claims, 2 Drawing Sheets

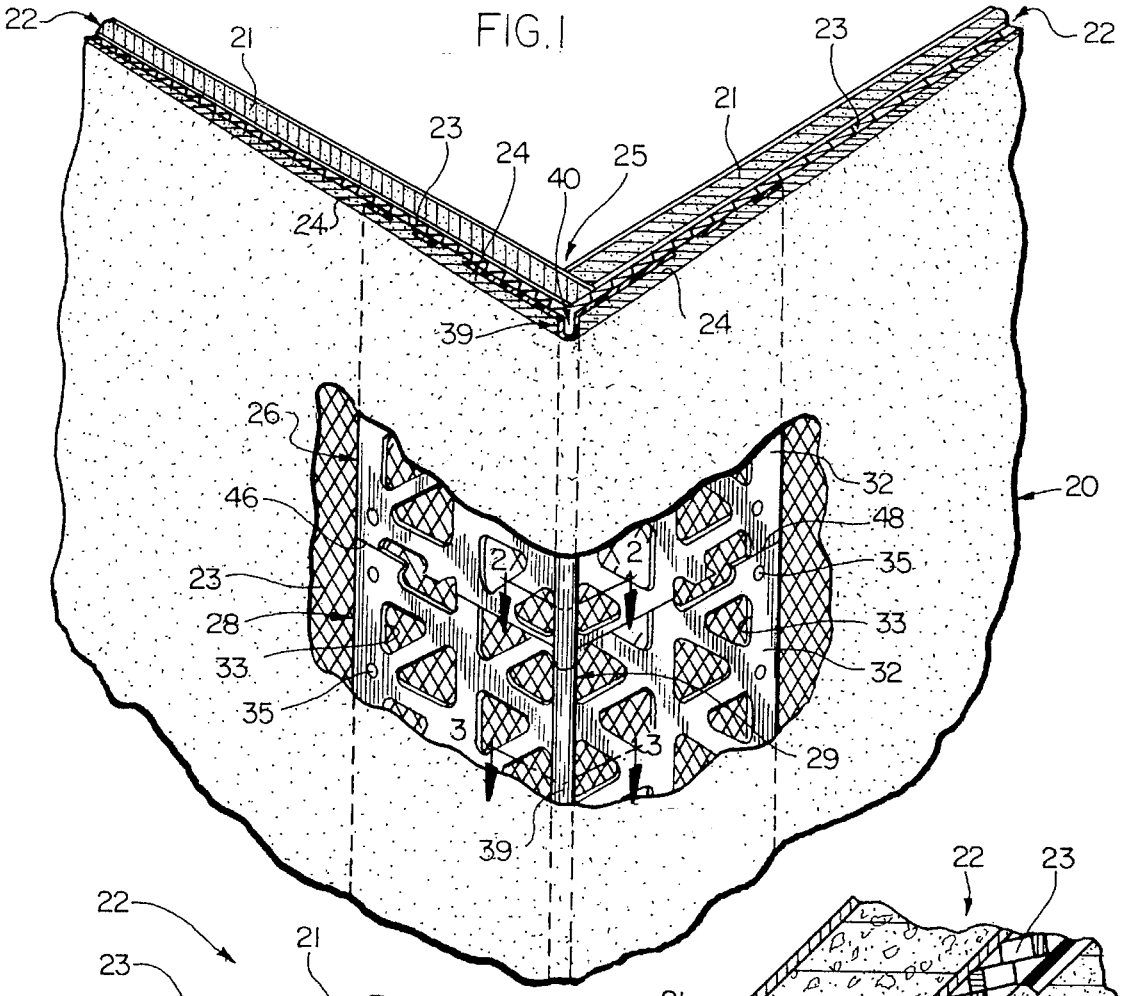
FIG. 1
22
21
23
24
25
40
39
26
46
28
33
35
32
48
20
2
3
29
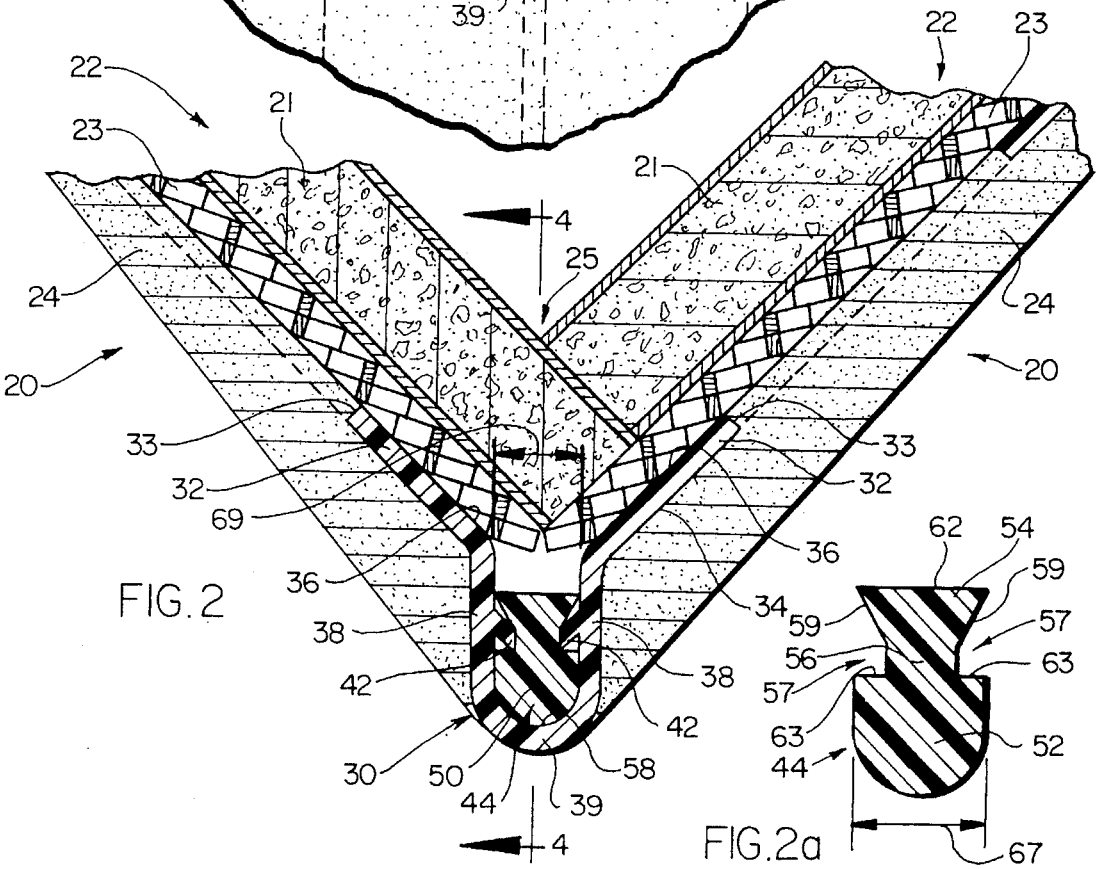
22
23
21
24
25
4
20
33
32
69
36
38
42
30
50
44
39
58
34
59
62
54
57
56
63
52
67
FIG. 2
FIG. 2a

CONNECTOR CLIP FOR CORNER BEAD

BACKGROUND

The present invention relates to corner or edge beading material and plaster building material accessories. More particularly, the present invention relates to an extruded corner edge strip and a clip for maintaining abutting ends of two corner edge strips in end-to-end engagement.

Plaster, cement, and other plastic or stucco type building materials are very popular for internal and external architectural applications. These materials are very desirable for providing a variety of surfaces and achieving a variety of architectural designs. The versatility of the material and techniques are being used, with increasing popularity, to create architectural designs for structures ranging from commercial to residential to industrial. Many of these applications involve large surfaces which may extend over large distances. For example, a multi-story structure may have several large planar surfaces which are uninterrupted or interrupted only by one or a few windows.

Well-known plastering or stuccoing techniques include constructing a base structure or frame upon which lath and successive layers of plastic materials, such as plaster, are applied. Another construction technique uses wallboard (also known as mineral board or gypsum board) panels attached to a structural frame. The seams and edges of the panels are covered with an appropriate joint compound and/or taping material. In either construction technique, a "finish coat" may be applied over the panels or built up plaster. Through practice and artistry, a craftsman employing the stuccoing techniques can achieve many types of architectural details.

One feature which is basic and essential to stucco or plaster construction is the edge, corner or casing joint. These features are constructed using some form of corner bead or casing material. The corner bead typically provides an arcuate corner of rigid construction which prevents chipping and nicking of the corner. Also, the corner beading provides a screed edge to screed a level surface over the intersection covered by the corner bead strip. In a similar manner, a bullnose bead provides the same benefits of a corner bead. The bullnose, however, is a larger radius arcuate surface, used to achieve a desired architectural effect. A casing bead or strip is used to provide generally planar cornered edges such as around a window or door casement.

Depending on the length of the intersection, several pieces of beading or strip material may have to be butted end-to-end in order to cover the entire length. Generally, the bead strips have one or more flanges extending from the arcuate portion or junction which allow the strip to be attached by nailing or screwing to the corresponding intersecting surfaces or wall structure. Once one strip is attached, another strip may be butted against the free end of the attached strip and secured in a similar manner.

Positioning of the abutting edges can be very difficult, a slight shift in one of the strips can throw the abutting edges out of alignment. It is very important to maintain highly precise alignment at the abutting ends since failure to maintain alignment will result in obvious angular irregularities along the intersection. For example, slight misalignment of two ends may create a noticeable shift along the entire length of the edge. Further, since such edges may extend over long distances (i.e. several stories), and the edges are used as screed edges, repeated shifts at abutting ends will make the finished plastered wall appear choppy, wavy, and in general aesthetically unpleasing.

For the forgoing reasons, it would be desirable to provide a corner bead and/or casing strip which may be positioned in end-to-end abutment with a second corresponding strip such that the abutting ends are in precise alignment.

OBJECTS AND SUMMARY OF THE PRESENT INVENTION

A general object of the present invention is to provide an extruded strip joining system for aligning abutting ends of axially elongated extruded strips to retain the strips in alignment.

Another object of the present invention is to provide an elongated strip joining system which may be used to quickly connect abutting ends of two corner bead strips.

Briefly, and in accordance with the foregoing, the present invention envisions an extruded strip joining system including a strip and a clip which cooperate to join free ends of extruded strips in precise abutment to maintain alignment of the strips. The strip joining system includes the strip which has an elongated junction portion and at least one elongated flange extending parallel to and away from the junction portion. The junction portion includes an internal surface and an external surface. Protruding structures are provided on the internal surface of the junction portion. A pair of axially elongated tabs are formed on the protruding structure depending from internal surface of the junction portion. The tabs are axially elongated along the strip and extend inwardly defining a channel therebetween. The clip is configured to engage the tabs thereby retaining the clip in the channel. Two strips are positioned with free ends abutting each other and a clip is positioned over the channel and pressed or slid into engagement with the tabs. Engagement of the clip with the tabs provides precise end-to-end positioning and axial alignment of the strips.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which:

FIG. 1 is a partial fragmentary, perspective view of a section of a wall corner structure and in which a portion has been removed to reveal abutting ends of two corner bead segments covered by plaster material;

FIG. 2 is a partial fragmentary, cross-sectional plan view taken along line 2—2 in FIG. 1 showing a clip engaged with a corner bead segment;

FIG. 2*a* is a cross-sectional plan view of the clip removed from engagement with the corner bead segment;

DETAILED DESCRIPTION OF THE PREFERRED EMBODIMENT

Figure 3:
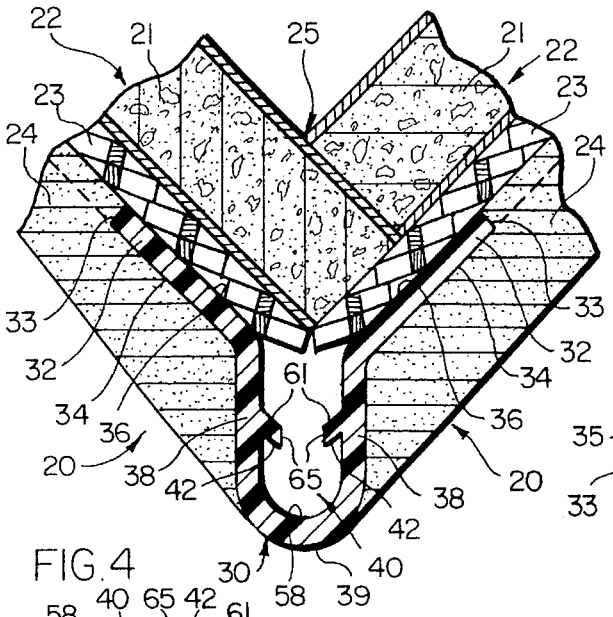
FIG. 3 is a partial fragmentary, cross-sectional view taken along line 3—3 in FIG. 1 showing the cross-sectional configuration of the corner bead segment which does not include the clip.

While the invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

With reference to FIG. 1, two intersecting plaster finished walls 20,20 are shown. The walls 20,20 provide a wall structure 22 comprised of gypsum sheathing 21 covered by an expanded metal lath material 23 over which a plaster material 24 has been applied to achieve a generally uniform planar finish. A portion of the planar walls 20,20 has been broken away at an intersection 25 of these two walls 20,20 to reveal two corner bead segments 26,28 in an end-to-end abutting relationship. The corner bead segments 26,28 are retained in the end-to-end relationship by an extruded strip joining system 29 of the present invention.

Figure 4:
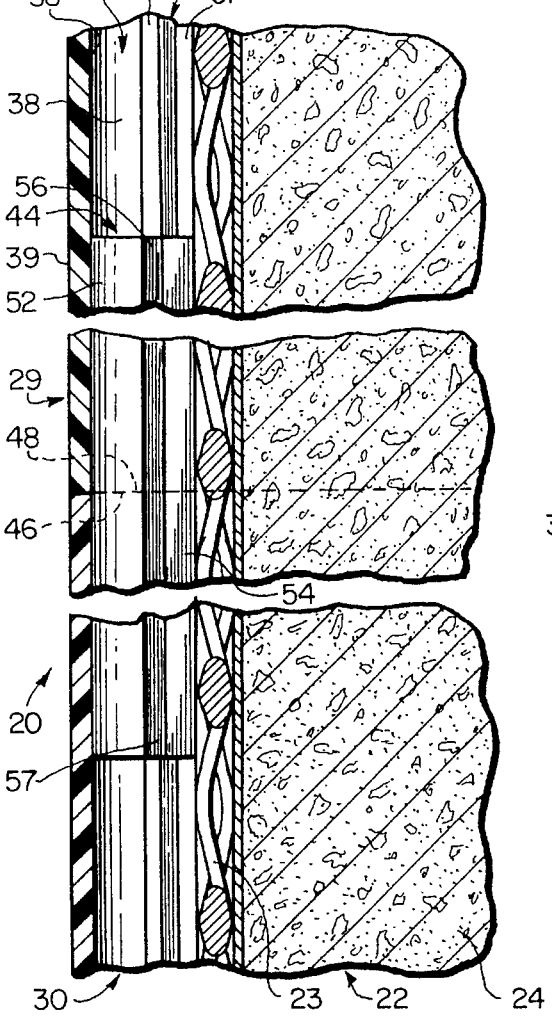
FIG. 4 is a partial fragmentary, cross-sectional, side elevational view taken along line 4—4 in FIG. 2 showing a clip positioned in coaxial alignment and engagement with a corner bead segment.
Figure 5:
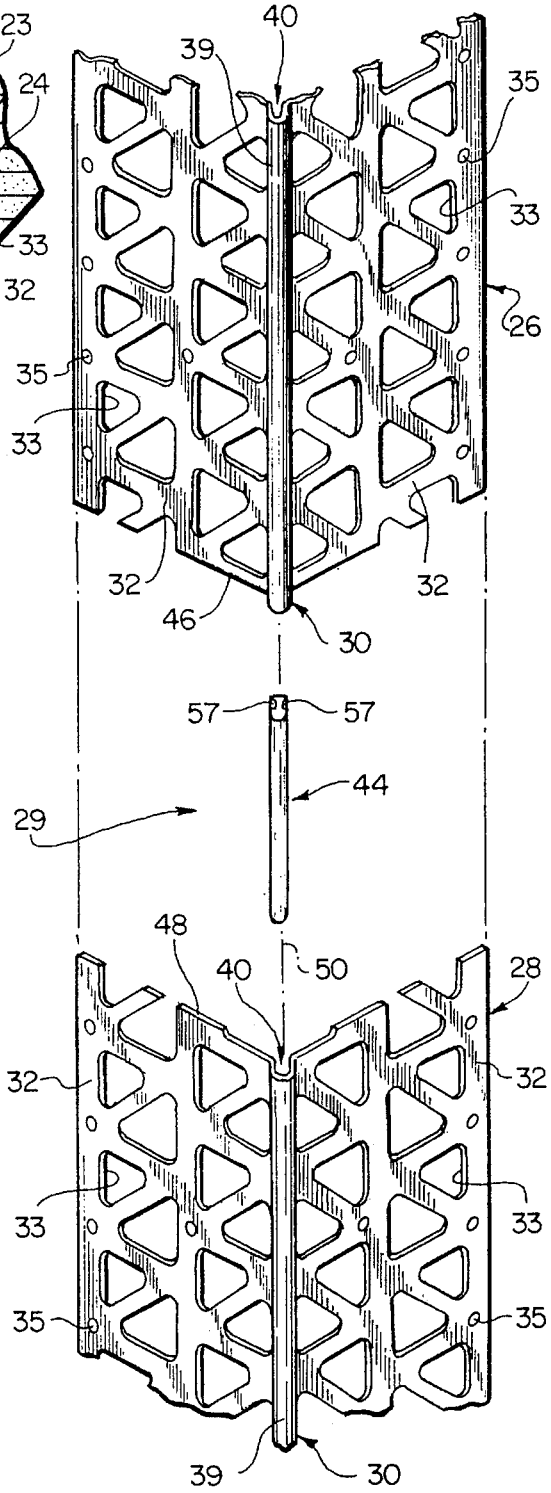
FIG. 5 is a partial, fragmentary exploded perspective view of two corner bead segments which have been separated and a clip which is positioned between the two segments.

The corner bead segments 26,28 are portions of elongated corner bead strips integrally extruded of a plastic material such as polyvinyl chloride. The corner bead strips used in the system include a junction portion 30 and at least one generally planar flange 32 extending away from a corresponding edge of a junction portion 30. As can be seen in FIGS. 1, 4 and 5, the corner bead strips 26,28 are axially elongated with a pair of flanges 32,32 extending from the junction portion 30 coaxial therewith. A multiplicity of keying apertures 33 and fastening apertures 35 are formed through the flanges 32. The keying apertures 33 are provided to provide greater engagement of the plaster 24 overlying the flanges 32. The fastening apertures 35 are provided to eliminate the need to predrill the flanges 32 when nailing or screwing the strips to walls.

With further reference to FIGS. 2,2*a*,3,4 and 5, the extruded strip joining system 29 includes the corner bead segments 26,28 having an exterior surface 34 and an interior surface 36, the junction portion 30 side walls 38 and an arcuate portion 39 defining a channel 40 therebetween. Axially elongated retaining means or tabs 42 extend from the interior surface 36 of the side walls 38 into the channel. Engagement means or clip means 44 are engageable with the channel 40 and retained therein by the axially elongated tabs 42.

It should be noted that the retaining means 42 and engaging means 44 can be configured for use in the channel 38 of junction portions 30 such as right angle junction portions which are found on case beading and large diameter arcuate portions 39 are found on bullnose beading strips. It is clearly within the scope of the present invention and claims to cover these variations in the dimensions or geometry of the junction portion 30.

As shown in FIG. 5, when two free ends 46,48 of the bead segments 26,28 are positioned for end-to-end abutment, the clip 44 is positioned in the channel (see, FIG. 4). One way of positioning the clip 44 in the channel 40 is by axial insertion of the clip 44 along a central axis 50 extending along the clip 44 and through the junction portion 30. Generally, half of the clip 44 is retained in the first bead segment 26 and the other half of the clip is retained in the second bead segment 28 with the segments 26,28 driven towards each other resulting in the free ends 46,48 abutting each other. FIGS. 2 and 4 show partial fragmentary cross-sectional plan and elevational views, respectively, of the clip 44 engaged in the channel 40.

As shown in the cross sectional plan views of FIGS. 2 and 2*a*, the clip 44 has a cross sectional structure which includes a head 52, a tail 54 and a reduced diameter neck 56 positioned between the head 52 and the tail 54. The neck 56 is defined by axially elongated grooves 57 formed along the clip 44 between the head 52 and the tail 54. The intersecting surfaces of the tail, neck and head 54,56,52 promote engagement and retention of the tabs 42 with the clip 44. Sloped surfaces 59 between the tail 54 and neck 56 promote positive engagement with corresponding sloped surfaces 61 of the tabs 42. Surfaces 63 between the head 52 and the neck 56 are generally perpendicular to the central axis 50 and provide positive engagement stop surfaces for the tips 65 of the tabs 42 when the clip 44 is engaged with the tabs 42. Further, a width dimension 67 of the clip 44 is substantially equal to a corresponding width dimension 69 of the channel 38 to promote conforming positive engagement.

The axially elongated tabs 42 are more clearly shown in FIG. 3 extending inwardly towards a concave interior surface 58 of an arcuate portion 39 of the junction 30. The tabs 42 are directed inwardly to positively retain the clip 44 by engaging the neck 56 of the clip 44. The head 52 is sized and dimensioned to abut the concave interior surface 58 of the arcuate portion 39.

The clip 44 or engaging means 44 engaged with the tabs 42 or retaining means 42 secures the two bead segments 26,28 in end-to-end relationship and prevents axial displacement of the junction portion 30 of the bead segments along the central axis 50. It is important to prevent axial displacement of the bead segments 26,28 since, as discussed in the background section, even slight displacement of the free ends 46,48 may result in misalignment of the bead segments 26 which is noticeable due to the angular deviation in the otherwise straight bead edge. Since the bead segments are also used as screed edges for forming planar surfaces, axial displacement of these screed edges translates into irregular planar surfaces.

In use, the extruded strip joining system of the present invention is used to retain two bead segments 26,28 in end-to-end engagement to provide a uniformly straight and apparently, to an observer, seamless joint. The joining system 29 includes the bead segments 26,28 and the clip 44 engageable with the tabs 42 of the bead segments 26,28.

When installing the corner bead segments 26,28 and the clip 44, the clip 44 is engaged with one segment either by axially inserting the clip 44 along the central axis 50 into the channel 40 or by forcibly pressing on a planar surface 62 of the tail 54 generally perpendicular to the central axis 50. The result of either method is engagement of the tabs 42 in the elongated grooves 57 defining the neck 56 of the clip 44. The inwardly angled tabs 42 and conformal fitting head 52 retain the clip 44 in intimate engagement in the channel 40.

Next, with a portion of the clip 44 retained in one of the segments, and a portion of the clip 44 extending therefrom, the second bead segment is engaged with the clip in a similar manner as carried out with the first bead segment 28. The flanges 32 of the corner bead strips are then attached to the corresponding sections of the wall structure 22 with the junction portion 30 overlying the intersection 25 of the walls 20,20. Regardless of minor deviations in attaching the flanges 32 to the walls, the abutting ends 46,48 of the bead segments 26,28 will be held in abutting engagement and resist axial displacement. The present invention substantially minimizes or eliminates the tedious positioning and matching required by the prior art. Further, the retaining means 42 and the engaging means 44 assure positive engagement and precise alignment of the ends of the bead segments 26,28 and prevent disengagement.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The Invention claimed Is:

1. An extruded strip joining system for aligning abutting ends of axially elongated extruded strips and retaining the abutting ends in end-to-end engagement, said extruded strips having an interior surface and an exterior surface, said joining system comprising:

means defining an axially elongated channel on an interior surface of each of said extruded strips;

a pair of axially elongated tabs integrally fabricated on said interior surface at generally symmetric positions in said channel; and clip means engageable with said tabs in said channel for retaining said abutting ends in engagement.

2. An extruded strip joining system as recited in claim 1, said clip means comprising an integrally fabricated single piece body having an axially elongated head, an axially elongated neck and an axially elongated tail, said neck being engaged by said tabs when said clip is inserted in said channel for retaining said clip in said channel, a portion of said clip being retained in each of two abutting strips for retaining the abutting end in end-to-end relation.

3. An extruded strip joining system as recited in claim 2, wherein said axially elongated neck includes a planar surface lying generally perpendicular to said neck, said planar tail surface providing a driving surface for pressing said clip into engagement with said channel.

4. An extruded strip joining system as recited in claim 1, wherein said extruded strip and said clip are fabricated from polyvinyl chloride.

5. An axially elongated corner bead strip for reinforcing and finishing corners in plaster finish structures, said strip comprising:

a junction portion axially extending along the length of said strip, said junction portion defining an exterior surface and an interior surface;

at least one generally planar flange projecting outwardly from a corresponding side of said junction portion, said planar flange axially extending along the length of said strip;

means for retaining abutting ends of two segments of said strip in end-to-end relation, said retaining means axially extending along the length of said strip on said interior surface of said junction portion; and means for engaging said retaining means, said engaging means mating with a portion of said retaining means located on said ends of said segments of said strip.

6. An axially elongated corner bead strip as recited in claim 5, said engaging means further comprising a clip for engagement with said means for retaining abutting ends of two segments of said strip in end-to-end relation, said clip engaging a section of said retaining means on each of two independent strip segments placed in end-to-end abutting relation for retaining said strip segments in an end-to-end abutting relation.

7. An axially elongated corner bead strip as recited in claim 5, wherein one of said planar flanges projects from each side of said junction portion.

8. An axially elongated corner bead strip as recited in claim 5, wherein said junction portion comprises an arcuate portion, said interior surface defining a concave surface and said exterior surface defining a convex surface.

9. An axially elongated corner bead strip as recited in claim 5, wherein said means for retaining abutting ends of two segments of said strip in end-to-end relation comprises two axially elongate tabs integrally fabricated with said junction portion and projecting from said interior surface of said junction portion.

10. An axially elongated corner bead strip as recited in claim 9, wherein said two axially elongated tabs are angled inwardly towards said interior surface of said junction portion.

11. An axially elongated corner bead strip as recited in claim 9, said engaging means further comprising a clip for engagement with said means for retaining abutting ends of two segments of said strip in end-to-end relation, said clip engaging a section of said retaining means on each of two independent strip segments placed in end-to-end abutting relation for retaining said strip segments in an end-to-end abutting relation, said clip being an integrally fabricated single piece body having an axially elongated head, an axially elongated neck and an axially elongated tail, said neck being engaged by said tabs when said clip is inserted in said retaining means, a portion of said clip being retained in each of two abutting strips for retaining the abutting ends of said strips in end-to-end relation.

12. An axially elongated corner bead strip as recited in claim 11, wherein said axially elongated tail includes a planar surface lying generally perpendicular to said neck, said planar tail surface providing a driving surface for pressing said clip into engagement with said retaining means.

13. In combination two corner bead segments for reinforcing and finishing corners in plaster finish structures and a clip engageable with abutting ends of said two corner bead segments, said combination comprising:

an arcuate portion extending along the length of each of said corner bead segments and at least one generally planar flange projecting outwardly from a corresponding side of said arcuate portion, said arcuate portion defining a concave interior surface;

said clip being axially elongated and engagable with a free end of each of said two bead segments joining said corner bead segments in end abutting relation; and means for engaging said clip integrally fabricated on said interior surface of said arcuate portion of said corner bead segments and on a corresponding exterior surface of said clip.

14. A combination as recited in claim 13, wherein one of said planar flanges projects from each side of said arcuate portion.

15. A combination as recited in claim 13, wherein said means for engaging said clip comprises two axially elongate tabs integrally fabricated on said arcuate portion and projecting from said concave interior surface of said arcuate portion.

16. A combination as recited in claim 15, wherein said two axially elongated tabs are angled inwardly towards said interior surface of said arcuate portion.

* * * * *